US005651416A

United States Patent [19]

Clauson et al.

[11] Patent Number: 5,651,416

[45] Date of Patent: Jul. 29, 1997

[54] FIRE EXTINGUISHING METHOD

[75] Inventors: Michael J. Clauson, Macomb County; John O. Hughes, Oakland County, both of Mich.

[73] Assignee: The United States of America as represented by the Secretary of the Army, Washington, D.C.

[21] Appl. No.: 659,613

[22] Filed: May 16, 1996

Related U.S. Application Data

[63] Continuation-in-part of Ser. No. 520,864, Aug. 22, 1995, abandoned .

[51] Int. Cl.[6] ..... A62C 3/07

[52] U.S. Cl. ..... 169/46; 169/62; 252/2

[58] Field of Search ..... 252/2; 169/43, 169/44, 46, 47, 62, 9

[56] References Cited

U.S. PATENT DOCUMENTS

| | | | |
|---|---|---|---|
| 2,745,807 | 5/1956 | Anthony, Jr. et al. | 252/2 |
| 3,274,105 | 9/1966 | Mevel | 252/2 |
| 3,338,829 | 8/1967 | Langguth et al. | 252/2 |
| 4,406,797 | 9/1983 | Altman et al. | 252/2 X |
| 5,085,786 | 2/1992 | Alm et al. | 169/46 X |

FOREIGN PATENT DOCUMENTS

| | | | |
|---|---|---|---|
| 2230437 | 10/1990 | United Kingdom | 169/62 |
| 93/25276 | 12/1993 | WIPO | 169/62 |

*Primary Examiner*—Andrew C. Pike

*Attorney, Agent, or Firm*—Peter A. Taucher; David L. Kuhn

[57] ABSTRACT

A scheme for essentially instantaneous kills of fires in crew compartments is shown which is effective over a wide variety of climatic temperatures. An extinguishant is mixed according to the formula, $(M^+A^-)_{sat}+H_2O+fps+d$ @T, where $A^-$ is either an acetate in the form $H_2CCOO^-$, chloride, or bromide, $M^+$is an alkali metal or ammonium, fps is a freezing point suppressant, d is a surfactant, and $(M^+A^-)_{sat}$ is a saturation level of compound $M^+A^-$ at temperature T. In one embodiment of our scheme, potassium acetate is both the $(M^+A^-)_{sat}$ and the fps in the foregoing formula. The scheme includes charging an extinguisher bottle with the extinguishant under pressure, opening a gate device connecting the bottle to a feeder line, and allowing the extinguishant to flow in the line to a nozzle. The extinguishant is then sprayed through the nozzle, which is disposed at the fire in the compartment. The scheme also includes passing the extinguishant past a container having an opening at the line. The opening has a screen barrier between water in the container and the line. When extinguishant flows past the opening, water from the container enters the line, thus offsetting water vaporization in the line and preventing precipitate depositing in the line.

14 Claims, 1 Drawing Sheet

FIRE EXTINGUISHING METHOD

This application is a continuation-in-part of application Ser. No. 08/520,864 filed Aug. 22, 1995, now abandoned, entitled "Fire Extinguishing Method," by Michael J. Clauson and John O. Hughes, the parent application having Attorney Docket number TA-2898.

GOVERNMENT USE

The invention described here may be made, used, and licensed by or for the U.S. Government for governmental purposes without paying us royalty.

BACKGROUND AND SUMMARY

The present invention relates to a method for extinguishing or "killing" fires of classes A, B, and C in enclosed spaces such as engine compartments and crew compartments of combat military vehicles. In the past, the most effective agents for fire killing have been Halons, and CFC and HFC type chemical gasses. Though effective against fires, these agents have adverse environmental effects and can be highly toxic. The present invention addresses the foregoing concerns by using water-based, relatively inert salts that do not have the toxicity or harmful environmental effects of Halons, CFC, or HFC gasses.

Presently, the most effective nontoxic fire extinguishing agents kill fires through a complex phenomenon that involves both cooling and chemically acting on reagents of the fire. The chemical aspect of the phenomenon is known as "free radical scavenging" or as a "free radical trap". Our scheme utilizes a halide salt or acetate salt dissolved in water that likewise both cools and chemically reacts to kill fires. Our extinguishant includes a nontoxic, nonflammable freezing point suppressant which makes the extinguishant useful in arctic climates. The extinguishant is also usable under extremely hot climatic conditions of deserts or tropical areas.

Our extinguishant has a surfactant to reduce the extinguishant's droplet size when the extinguishant is sprayed. In our overall fire extinguishing scheme, the extinguishant's chemical reactions occur only in the presence of heat from an incident fire, whereby these reactions do not unintentionally occur during accidental discharge of the extinguishant. Consequently, our fire extinguishing scheme is safer than many known fire fighting methods.

In some instances in our use of the extinguishant, it may flow in a line past a small phial or container whose mouth opens to the line. Across the mouth is a screen coated on one side with polytetrafluorethylene (TEFLON®), the screen retaining water in the phial unless extinguishant in the line flows past the screen. Water from the phial replaces water that may be vaporized downstream of the phial. The screen prevents deposits of the extinguishant from forming in the line and clogging the line. Articles such as boats and coffee cups have previously been made, at least for demonstration purposes, from the same material as the aforementioned screen, but we believe it is not known to use such a screen as we have.

DETAILED DESCRIPTION

Figure 1:
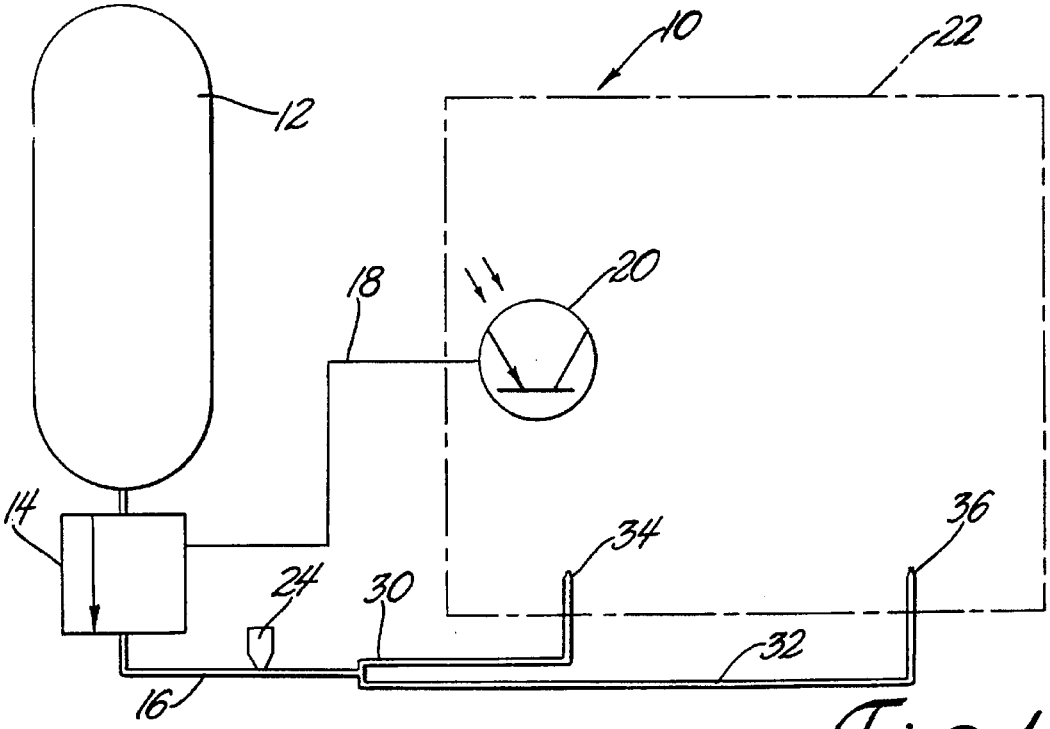
FIG. 1 is an essentially schematic diagram of a fire extinguishing system used in conjunction with our fire killing scheme.

The preferred composition of the fire extinguishant used in our system is a water based solution that can be described in a generic formula as follows:

$$(M^+A^-)_{sat}+H_2O+fps+d\ @T$$

In this formula, $A^-$ can be the acetate ion $H_2CCOO^-$, but $A^-$ can also be chloride, bromide, or iodide. The term $(M^+A^-)_{sat}$ denotes that the amount of the chemical compound $M^+A^-$ used is saturated in water at a selected temperature T. The compound $M^+A^-$ is not necessarily saturated for all possible applications, but maximizing the amount of $M^+A^-$ dissolved in the water enhances the effectiveness of the extinguishant. We prefer a saturated level of $M^+A^-$ at T in our extinguishment scheme for killing fires in closed compartments of combat vehicles, since these vehicles typically carry live ammunition. The term fps denotes any suitable freezing point suppressant for water, and d is a surfactant for water, such as a soap or a detergent. Ordinary tap water can be used for the extinguishant, although purified water makes a slightly more efficacious extinguishant since purified water holds more $M^+A^-$ in solution.

It is preferred that the amount of $M^+A^-$ and fps not exceed their saturation levels in water at temperature T. Otherwise, the $M^+A^-$ or fps may possibly precipitate and may then obstruct lines or nozzles in the extinguishant delivery system shown in FIG. 1, assuming the lines or nozzles have relatively small inner diameters. Consequently, after the extinguishant is mixed, it is cooled to temperature T, or perhaps a few degrees lower, and then held at this temperature for approximately 15 minutes. The liquid extinguishant is then pipetted or siphoned off, whereby any excess salt or other precipitate is separated from the extinguishant.

Since personnel typically occupy the closed compartments of military vehicles about which we are concerned, it is desirable that the ingredients of the extinguishant be nontoxic to humans and have no damaging effects on human tissue. Sodium halide, sodium acetate, sodium iodide, lithium halide, lithium acetate, lithium iodide, potassium halide, potassium acetate, potassium iodide, ammonium halide, ammonium acetate, and ammonium iodide, in the concentrations described above, are nontoxic and nondamaging to humans; and these substances are also not unacceptably corrosive. There are likewise suitable freezing point suppressants which are nontoxic and not overly corrosive in the concentrations described above. Such suppressants include ferric halide, ferric chloride, ferric acetate, potassium carbonate, lithium chloride, lithium acetate, sodiumacetate, urea ($NH_2CONH_2$) strontiumhalide, strontium chloride, strontium iodide, glycerol ($CH_2OHCHOHCH_2$ OH), ethylene glycol, potassium acetate, potassium iodide, and potassium bromide; and these suppressants are nonflammable as well. Other freezing point supressants include sodium halide, lithium halide, potassium halide, ammonium acetate, amonium halide, ferric halide, strontium acetate, and strontium halide Suitable surfactants include water soluble oils such as cutting oils, detergents, stearic acids, aldic glycerides, and soaps such as commercially available dish washing soaps or hand soaps, preferably those that do not irritate human skin or eyes.

The most favored mixture effecting essentially instantaneous fire kills has 9.0 to 9.5 grams of potassium acetate for every 10 milliliters of water combined with 1 gram of soap. In this mixture, the potassium acetate will be saturated in water at a temperature T of −60 to −65 degrees Fahrenheit. T was chosen here to be −60 to −65 degrees Fahrenheit because −60 degrees Fahrenheit is the coldest temperature expected to occur in a military vehicle compartment, even in an arctic climate. T can be set at any temperature, but it normally is at or slightly below the lowest expected temperature of the places where our fire extinguishant is used. Potassium acetate not only acts as a fire killing agent by supplying an acetate radical to a combustion reaction but also suppresses the extinguishant's freezing point. In similar fashion, sodium acetate, lithium acetate, lithium iodide, sodium iodide, or potassium iodide could serve the dual purposes of fire killing agent and freezing point suppressant.

Regarding the above generic formula, the amount of detergent can be varied from 1 or more grams of detergent per 10 milliliters of water (a 10% solution) to as little as 1 gram of detergent per 12 liters of water. Adding more than 1 gram of soap or other detergent per 10 milliliters of water is possible, but has no appreciable fire killing benefit. The addition of at least 3% soap by weight approximately doubles the speed of the extinguishant's action. That is, a fire of a given size can be killed in about half the time if 3% soap is added. In the alternative, if at least 3% soap is added then about two-thirds as much extinguishant is needed to kill a given fire without slowing the extinguishant's action. In the most favored mixture described above, the combination of soap with potassium acetate approximately quadruples the speed of the extinguishant as compared to plain water. I.e., the most favored mixture kills fires in about one-fourth the time required by plain water.

Figure 2:
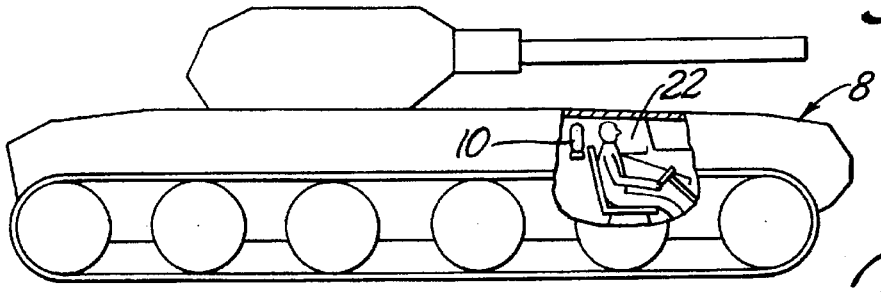
FIG. 2 is a cutaway view showing a typical placement of a fire extinguishing system in a crewman's compartment of a tank.
Figure 3:
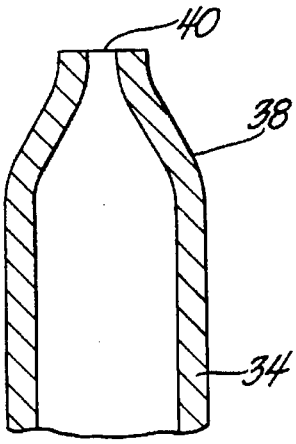
FIG. 3 is a sectioned view of a nozzle used in the system shown in FIG. 1.

FIG. 1 is a semischematic diagram of a fire fighting system 10 in which our extinguishant is used, where a conventional inverted extinguisher bottle 12 typically holds 1.5 to 8 liters of extinguishant at a pressure of 750 to 1000 psi. It is not necessary that the extinguishant be stored under pressure; rather, it is only necessary that pressure be supplied when bottle 12 is to be discharged. Suitable means of supplying pressure include pistons driving through cylinders, or breakable packets of propellant such as those found in air bags for passenger cars. Other kinds of extinguisher bottles besides bottle 12 may be used, but bottle 12 is preferred since it is the type already commonly installed on US Army combat vehicles. Bottle 12 is typically charged by first adding our extinguishant and then pressurizing the bottle with nitrogen gas. A gate device 14 controls the flow of extinguishant from bottle 12 to feeder line 16. Gate device 14 is shown as a valve in FIG. 1, but device 14 can be another known mechanism such as a membrane or a sheet of material together with componentry to puncture the membrane in response to an appropriate signal. Device 14 opens to release extinguishant from bottle 12 in response to a signal along line 18 from sensor 20. Sensor 20 can be a heat sensor, a photoelectric element, or optical sensor within military vehicle 8 in a compartment 22, the sensor designated by dashed lines in FIG. 1. Compartment 22 is also shown in the cutaway portion of tank in FIG. 2.

Figure 4:
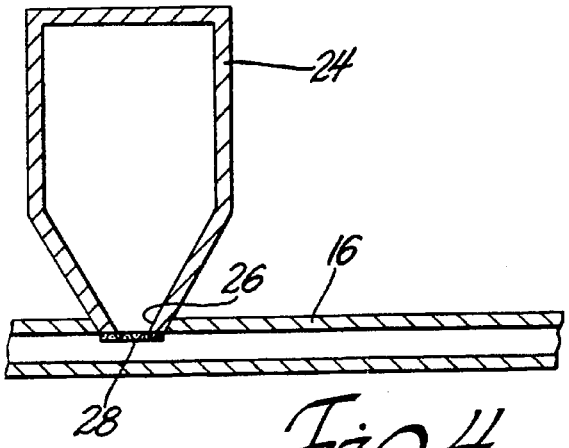
FIG. 4 is a sectioned view of a cruse or phial opening into a feeder line of the FIG. 1 system.

Opening into to line 16 is an inverted phial or cruse 24 at whose open end 26 (FIG. 4) is a fine mesh screen or barrier 28 having a polytetrafluorethylene coating on one side. Screen 28 intrudes slightly into line 16. Cruse 24 contains a small quantity of preferably pure water, the quantity typically being between half an ounce and sixteen ounces. The screen's mesh is sized so the screen's coating and the water's surface tension coact to keep the water from leaving cruse 24 through the screen if no extinguishant flows by the screen in line 16. When extinguishant does flow past screen 28, water from cruse 24 is drawn into the flowing extinguishant. Screen 28 normally has 200 to 300 meshes per square inch, and the polytetrafluorethylene coating is on the side of the screen facing toward cruse 24. Preferably, screen 28 has no more than 300 meshes per square inch. Otherwise the coating will keep water from going through screen 28 from its coated side even if the extingushant flows past screen 28.

The extinguishant flows from feeder line 16 to distribution lines 30 and 32, which lead back to compartment 22. At termini 34 and 36 of lines 30 and 32 are spray nozzles or nozzle-like ends such as that seen at 38. Termini 34 and 36 taper to a preferred diameter of 0.5 millimeters to 3 millimeter at orifice 40. In our tests, the droplet size of the sprayed extinguishant was 100 to 250 μm and was effective against fires within compartment 22. Larger droplets would be needed for fires at ranges exceeding several feet, such ranges being greater than those encountered in compartment 22. Droplets bigger than 15 μm are highly desired for human-occupied compartments since droplets 15 μm or smaller can be absorbed by the human lung and salt abrasion of the lungs could occur.

Possibly, very hot fires can heat lines 30 and 32 and nozzles 38 enough to vaporize water from the extinguishant as the extinguishant first arrives in these lines or nozzles, whereby precipitate deposits there. Cruse 24 prevents the deposition of precipitate, which may obstruct subsequent flow of extinguishant in system 10. Water from cruse 24 is drawn into the extinguishant as the extinguishant begins to flow past cruse 24 through the lines. Water from cruse 24 offsets any vaporization of the extinguishant's water that occurs before the extinguishant exits the nozzles, whereby cruse 24 is a means to eliminate line or nozzle blockage due to precipitation. The vaporization of water in lines 30 and 32 does not present a problem at temperatures where the water in cruse 24 is frozen.

We do not desire to be limited to the exact details of construction or method shown herein since obvious modifications thereto will occur to those skilled in the relevant arts without departing from the spirit and scope of the following claims

We claim:

1. A method to effect an essentially instantaneous kill of fire, the method comprising:

preparing an extinguishant according to the formula $$(M^+A^-)_{sat}+H_2O+fps+d\ @T$$

where $A^-$ is selected from a group consisting of acetate, chloride, bromide, or iodide, $M^+$is selected from a group consisting of alkali metals and ammonium, fps is a nonflammable nontoxic freezing point suppressant, d is a surfactant, and $(M^+A^-)_{sat}$ is a saturation level of compound $M^+A^-$ at a selected temperature T;

charging a bottle with the extinguishant;

placing the bottle in a desired location;

sensing an incident fire at the location;

opening a gate device communicating the bottle to a line in response to the sensing;

preventing precipitate deposition in the line by allowing the extinguishant to flow in the line past a container having an opening at the line, the opening having a screen barrier thereacross between water in the container and the line; and spraying the extinguishant through a nozzle in the line disposed at the fire after the extinguishant passes the opening of the container.

2. The method of claim 1 further including the step of maintaining a pressure between 750 psi and 1000 psi in the bottle at least until the extinguishant begins exiting the bottle;

wherein the step of spraying the extinguishant comprises spraying the extinguishant through a nozzle orifice between 0.5 millimeters and 3 millimeters in diameter.

3. The method of claim 1 where the fps is selected from a group consisting of sodium halide, sodium acetate, lithium halide, lithium acetate, potassium halide, potassium acetate, ammonium halide, ammonium acetate, ferric halide, ferric acetate, potassium carbonate, urea, strontium acetate, strontium halide, and glycerol.

4. The method of claim 1 wherein the $M^+A^-$ and the fps are the same substance.

5. The method of claim 4 wherein the $M^+A^-$ and the fps are selected from a group consisting of potassium acetate, sodium acetate, ammonium acetate, and lithium acetate.

6. The method of claim 1 wherein:

the surfactant is a soap; and concentration of the soap is at least 1 gram of the soap per 12 liters of water.

7. The method of claim 6 wherein the concentration of the soap is 1 gram per 10 milliliters of water or less.

8. The method of claim 1 wherein the step of spraying the extinguishant includes formation of spray droplets at least 15 μm but no more than 250 μm in diameter.

9. The method of claim 1 wherein the container is an inverted phial able to hold a quantity between one-half ounce and 16 ounces of water.

10. A method for effecting an essentially instantaneous fire kill, the method comprising:

preparing an extinguishant according to the formula $$(M^+A^-)+H_2O+fps\ @T$$

where $A^-$ is selected from the group consisting of acetate, chloride, bromide, or iodide, $M^+$ is selected from a group consisting of alkali metals and ammonium, fps is a nonflammable nontoxic freezing point suppressant and T is a selected temperature;

charging an extinguisher bottle with the extinguishant;

pressurizing the bottle from a source of pressure;

opening a gate device communicating the extinguisher bottle to a line;

offsetting vaporization of water from the extinguishant in the line downstream of the gate; and spraying the extinguishant through a nozzle in the line.

11. The method of claim 10 wherein the step of spraying the extinguishant includes formation of spray droplets no larger than 250 μm.

12. The method of claim 10 wherein the fps is selected from a group consisting of sodium halide, sodium acetate, lithium halide, lithium acetate, potassium halide, potassium acetate, ammonium halide, ammonium acetate, ferric halide, ferric acetate, potassium carbonate, urea, strontium acetate, strontium halide, and glycerol; and the $M^+A^-$ is selected from a group consisting of potassium iodide, sodium iodide, and lithium iodide.

13. The method of claim 12 wherein the $M^+A^-$ and the fps are the same substance.

14. The method of claim 10 wherein the step of offsetting vaporization comprises:

communicating a container having water therein with the line;

placing a fine mesh screen in a flow path of the water from the container to the line so that one side of the screen faces downstream relative to the flow path; and coating the one side with polytetrafluorethylene.

* * * * *